US005278998A

United States Patent [19]

Book

[11] Patent Number: 5,278,998

[45] Date of Patent: Jan. 18, 1994

[54] COMBINATION GARMENT AND TOTE BAG

[76] Inventor: Steven C. Book, 10220 Scenario La., Los Angeles, Calif. 90077

[21] Appl. No.: 15,556

[22] Filed: Feb. 9, 1993

[51] Int. Cl.[5] ..... A41D 15/04

[52] U.S. Cl. ..... 2/102; 2/94; 190/1; 224/151; 383/4

[58] Field of Search ..... 2/69, 69.5, 85, 93, 2/94, 102, 108, 243; 190/1; 224/151, 202, 251, 252, 253, 257; 383/4

[56] References Cited

U.S. PATENT DOCUMENTS

| | | | |
|---|---|---|---|
| 2,165,348 | 7/1939 | Daiber | 2/94 |
| 2,744,253 | 5/1956 | Freedman | 2/69.5 |
| 3,412,410 | 11/1968 | Denfeld | 383/4 |
| 4,188,988 | 2/1980 | Agyagos | 150/1.7 |
| 4,475,251 | 10/1984 | Hopkins | 2/94 |
| 4,483,469 | 11/1984 | Arisland | 224/151 |
| 4,637,076 | 1/1987 | Tartt et al. | 2/102 |
| 4,700,409 | 10/1987 | De Lott | 2/94 |
| 5,014,359 | 5/1991 | Hanson | 2/94 |

FOREIGN PATENT DOCUMENTS

| | | | |
|---|---|---|---|
| 233097 | 8/1987 | European Pat. Off. | 383/4 |

*Primary Examiner*—Clifford D. Crowder

*Assistant Examiner*—Diana L. Biefeld

*Attorney, Agent, or Firm*—Klein & Szekeres

[57] ABSTRACT

A garment in the form of a vest of jacket comprises a pair of front panels attached to either side of a back portion. The panels define a pair of opposed front edges, each of which is contiguous with one of two bottom edge segments. A vertical bifurcation is formed in the lower part of the back section, defined between a pair of bifurcation edges, each of which is contiguous with one of the bottom edge segments. A first zipper is provided, which, when closed, joins the front panel edges to each other, the bottom edge segments to each other, and the bifurcation edges to each other. When the first zipper is so closed, and the garment is turned inside-out, a bag is formed, with the closed zipper defining a closed bag bottom and closed bag ends, the bag having a top opening defined between a pair of opposed top edges. Fastening means, such as a second zipper, are provided on the interior surface of the garment, and positioned so as to be aligned along the top edges when the first zipper is closed and the garment is turned inside out. The upper portions of the back portion and the front panels are folded into the top opening, and the fastening means can be selectively co-engaged to close the bag.

25 Claims, 3 Drawing Sheets

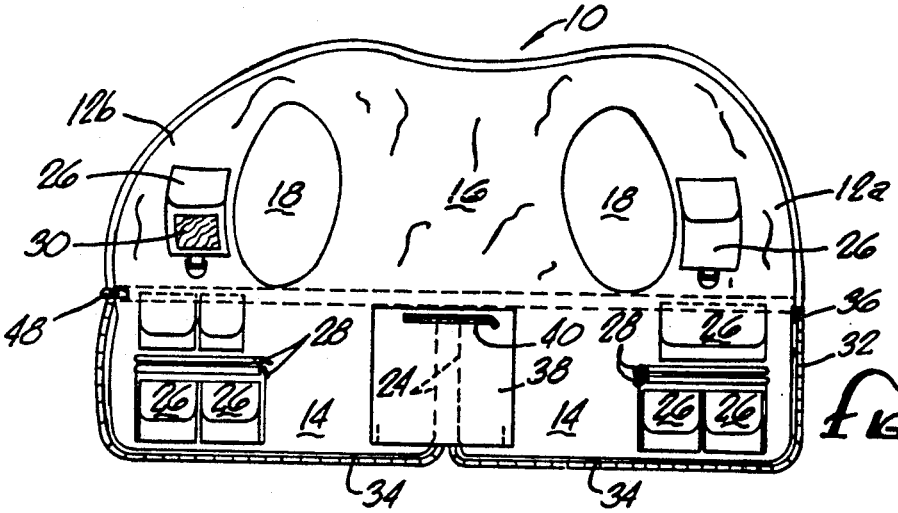
FIG. 3a.
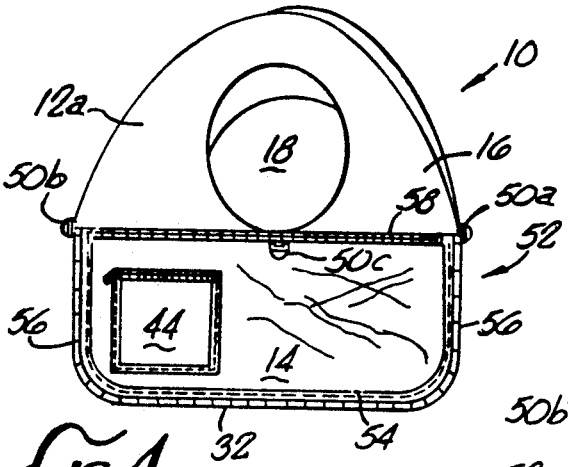
FIG. 4.
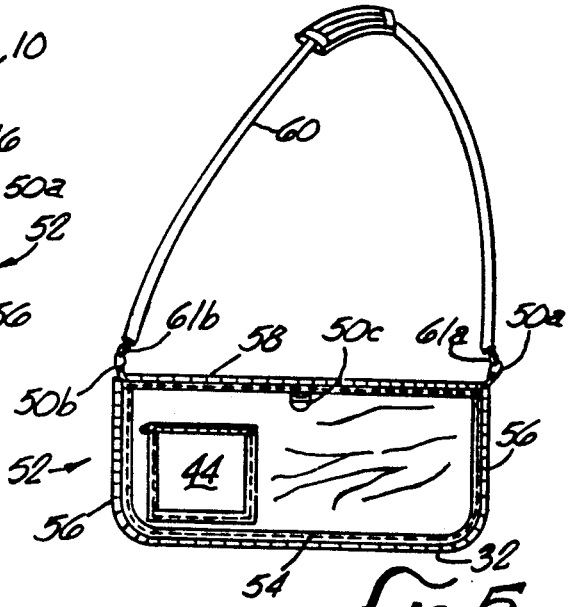
FIG. 5.
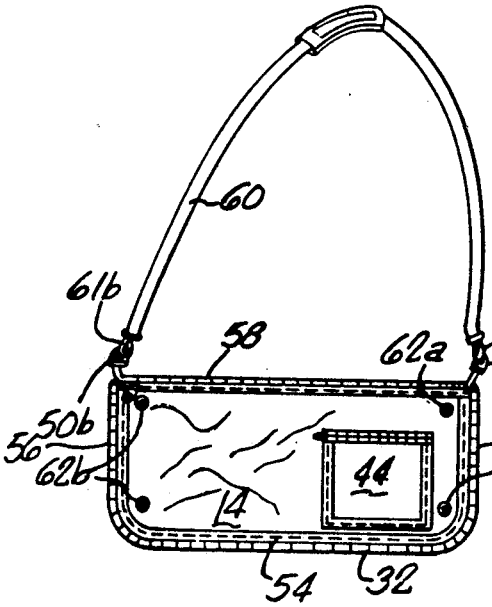
FIG. 6.
FIG. 7.
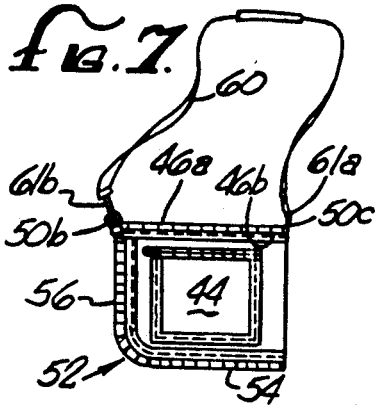

COMBINATION GARMENT AND TOTE BAG

BACKGROUND OF THE INVENTION

This invention relates generally to the field of garments. More specifically, it relates to a type of garment that is convertible into a tote bag, or a shoulder bag, or the like.

The utility and practicality of garments that are convertible into carrying bags have been well appreciated in the prior art. For example, vests or jackets that can be folded for conversion into purses, shoulder bags, and the like are disclosed in the following U.S. Pat. No. 4,637,076 - Tartt et al ; U.S. Pat. No. 4,475,251 - Hopkins; U.S. Pat. No. 4,700,409 - De Lott; U.S. Pat. No. 4,483,469 - Arisland; and U.S. Pat. No. 2,165,348 - Daiber.

In designing such convertible garment/bag combinations, it is desirable to provide a construction that is both economical to manufacture and simple to use, that is, to convert from a garment into a bag and back again. Another consideration is to compromise as little as possible the utility of the device in either its garment mode or its bag mode. A secondary, but still important, consideration is that the aesthetic qualities of the device, especially in the garment mode, be maintained to the greatest extent possible. Indeed, the ultimate goal is to provide a fully utilitarian and aesthetically pleasing garment that is easily and quickly convertible into a fully utilitarian and aesthetically pleasing bag. The prior art patents listed above demonstrate various approaches to this ultimate goal, and various degrees of success in achieving it.

In short, there is still a largely unmet need for a convertible garment/bag that fulfills the criteria set forth above, and that can be manufactured at a relatively low cost.

SUMMARY OF THE INVENTION

Broadly, the subject invention is a garment, such as a vest or a jacket, that includes a back portion and first and second opposed front panels joined to opposite sides of the back portion. Each of the front panels has a substantially vertical front edge, with a first or main zipper having a first zipper track that extends downwardly, along the front edges, from a front terminus, then along the bottom edges of the garment, and then part way up the back of the garment, along the edges of a central vertical bifurcation, to a rear terminus.

In the preferred embodiment of the invention, the main zipper has a single, "reverse action" slider, with both inside and outside pull tabs, that closes the zipper as it is moved downwardly from the front terminus of its track to close the garment around the wearer's torso, and opens the zipper when it is moved upwardly along the front edges of the front panels toward the front terminus.

A second zipper extends horizontally across the inside of the garment, just below the arm holes. The second zipper comprises first and second, horizontally-aligned, single rows of teeth. The first and second rows of teeth extend from opposite front panel edges of the garment to end points proximate the middle of the back of the garment, near the rear terminus of the main zipper. The respective end points of the two rows of teeth are separated by a short space in the middle of the back of the garment, near and slightly above the rear terminus of the main zipper track. A slider is disposed on one of the rows of teeth.

The preferred embodiment, when worn as a vest or jacket, has the slider of the main zipper zipped down the front edges of the front panels to close the garment, as opposed to a conventional zippered garment, which zips up the front to close it. To convert the garment into a bag, the main zipper is opened by sliding its slider up to the front terminus, and removing it from one of its tracks, allowing the wearer to remove the garment. The slider of the main zipper is then retracked, and zipped down along the front edges of the front panels, then along the bottom edges of the garment, and then all the way to its rear terminus in the middle of the back of the garment The garment is turned inside-out, forming a bag with a closed bottom and sides, and with the two rows of teeth of the second zipper being brought along side each other to define substantially parallel edges of an open bag top.

The upper portion of the garment (i.e., the upper back portion and the upper portions of the front panels) is then folded down over the lower portion, thereby tucking the upper portion of the garment into the open bag top. The slider of the second zipper is then used selectively to close and reopen the bag. Conversion of the bag back into a garment is accomplished by a simple reversal of the above-described steps.

The preferred embodiment includes several features that enhance the practicality of the device. For example, attachment means, such as "D" rings, are provided at appropriate places for the removable attachment of a shoulder strap or handle. Fastening means, such as snaps or hook-and-loop fasteners, are advantageously provided at locations that allow the bag to be folded over itself, with one end removably attached to the other, for more compact and convenient carrying. A flap of material is advantageously fastened to the back of the garment, so as to form a cover over the portion of the main zipper that extends up the bifurcation in the back of the garment. This cover, which serves an aesthetic purpose, is preferable formed as a pocket, so that it serves a utilitarian purpose as well.

As will be more fully appreciated from the detailed description that follows, the present invention provides a combination garment and bag, wherein the device converts quickly and easily from a garment configuration into a bag configuration, with little or no compromise in the functional attributes of either configuration. Moreover, the aesthetic qualities of the device, especially in the garment mode, are maintained to a very great extent. In addition, the device can be economically manufactured out of a wide variety of natural and synthetic fabric materials.

BRIEF DESCRIPTION OF THE DRAWINGS

FIG. 3*a* is an elevational view of the garment configuration after its removal by the wearer, and before conversion into the tote bag configuration, showing the side that forms the exterior of the garment configuration and the interior of the tote bag configuration;

FIG. 4 is a side elevational view of the device during an intermediate step in its conversion into its tote bag configuration;

FIG. 5 is a side elevational view, similar to that of FIG. 4, but showing the device after the completion of its conversion into its tote bag configuration;

FIG. 6 is a side elevational view of the device after its conversion into its tote bag configuration, but showing the side opposite to that shown in FIGS. 4 and 5, more particularly the side on which are disposed means for fastening one end of the bag to the other; and FIG. 7 is a side elevational view of the device, showing the device in its tote bag configuration after the fastening means have been used to fasten one end of the bag to the other.

DETAILED DESCRIPTION OF THE INVENTION

Figure 1:
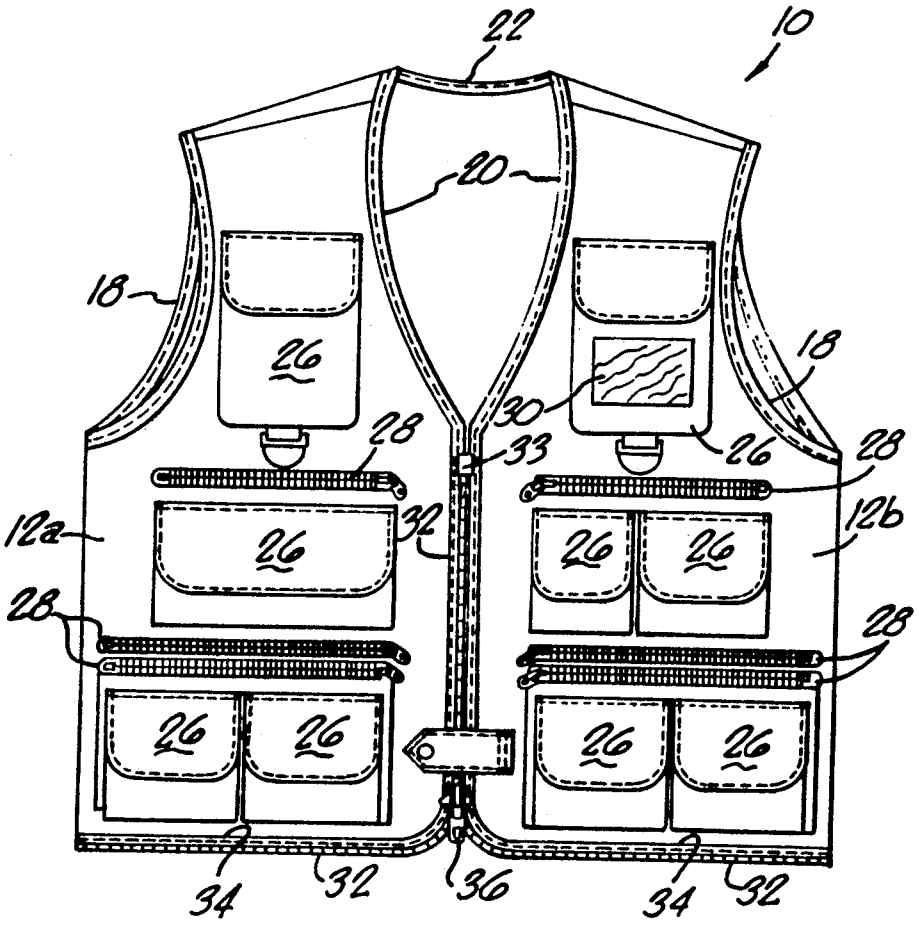
FIG. 1 is a front elevational view of the garment configuration of a convertible garment and tote bag device, in accordance with a preferred embodiment of the present invention.
Figure 2:
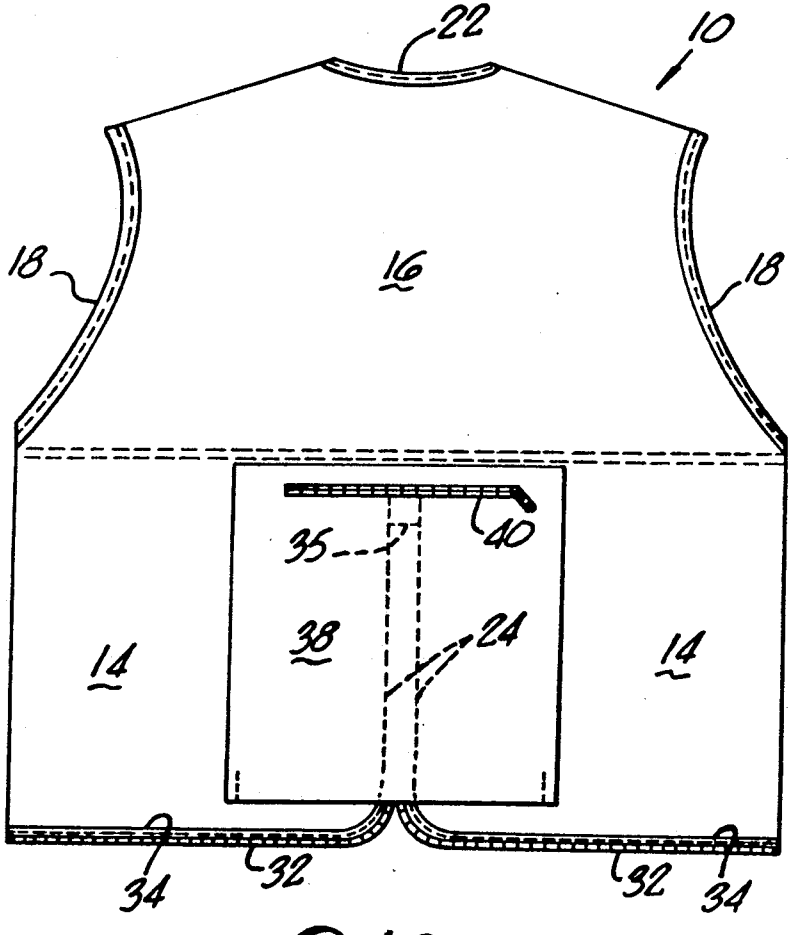
FIG. 2 is a rear elevational view of the garment configuration of the embodiment of FIG. 1.

Referring first to FIGS. 1, 2, and 3*a*, a convertible garment and tote bag device 10 is shown configured as a vest, as it would be worn by a person (not shown). In the vest configuration (hereinafter simply referred to as a "vest"), the device 10 includes a pair of opposed front panels 12*a*, 12*b* of flexible fabric material, each joined along its side to a lower back portion 14, and at its top to an upper back portion 16 that is integral with the lower back portion 14. The front panels 12*a*, 12*b* define a pair of opposed substantially vertical, front panel edges 17*a*, 17*b* that are respectively contiguous with first and second bottom edge segments 34*a*, 34*b*.

The lower back portion 14 and the upper back portion 16 are preferably formed from the same flexible fabric material as are the front panels 12*a*, 12*b*. An arm hole 18 is defined between the upper back portion 16 and each of the front panels 12*a*, 12*b*, while a collar is defined by cut-away upper portions 20*a*, 20*b* in the respective front panels 12*a*, 12*b*, and by a concavity 22 in the top center of the upper back portion 16. The lower back portion 14 includes a vertical central bifurcation defined between a pair of opposed bifurcation edges 24, for reasons that will become evident below.

The embodiment shown is configured as a fishing vest, with a plurality of flapped pockets 26 and zippered pockets 28 in the front panels 12*a*, 12*b*. A lamb's wool fly patch 30 is advantageously provided on the exterior surface of one of the flap pockets 26. It will be appreciated that alternative embodiments can be devised that will be configured as other types of vests, such as might be preferred by hikers, hunters, photographers, skiers, or devotees of other specialized endeavors. Still other embodiments may be configured as sleeved garments, such as jackets, shirts, or sweaters. Depending on the preference of the wearer, any number of natural or synthetic materials may be used for the front panels 12*a*, 12*b* and the back portions 14, 16. For example, these portions may be made of canvas, leather, cotton, cotton/polyester blend, nylon, or polymeric materials.

The device 10 includes a first or main zipper, with a track 32 that extends from a front terminus 33 near the collar, down the opposed front edges 17*a*, 17*b* of the front panels 12*a*, 12*b*, respectively, then along the first and second bottom edge segments 34*a*, 34*b*, respectively. The track 32 continues along the bifurcation edges 24, each of which is contiguous with one of the bottom edge segments 34*a*, 34*b*, to a rear terminus 35 in the lower back portion 14, at the upper end of the bifurcation edges 24.

The main zipper includes a slider 36, of the "reversible" type, i.e., having pull tabs on both the inside and the outside (although only one of the pull tabs is shown in the drawings). The main zipper is installed so that the slider 36 is initially engaged on the track 32 at the top of the front of the vest, i.e., at the collar, whereby the zipper is closed by moving the slider 36 down the front panel edges 17*a*, 17*b*. While this is the reverse of the situation in conventional zippered garments that are closed by sliding the slider up, the use of a "reverse action" slider simplifies the invention, by allowing a single slider to be used both to close the front of the vest while it is being worn, and to convert the vest into a tote bag by being zipped all the way along the length of the track 32 to the rear terminus 35 in the back of the vest.

Aesthetic considerations may dictate that the bifurcation defined between the bifurcation edges 24 be concealed. Consequently, a square or rectangular cover 38 may be sewn, or otherwise fastened, to the lower back portion 14 of the vest. The cover 38 is advantageously fastened along its upper edge, and at the corners only of its lower edge, so as to provide access to the main zipper track 32, and to the slider 36 when it is located in that segment of the track. In the preferred embodiment, the cover 38 is formed from a double layer of material, fastened together at the bottom to form a pocket, which may be closed by a zipper 40, or by other closure means (not shown)

Figure 3B:
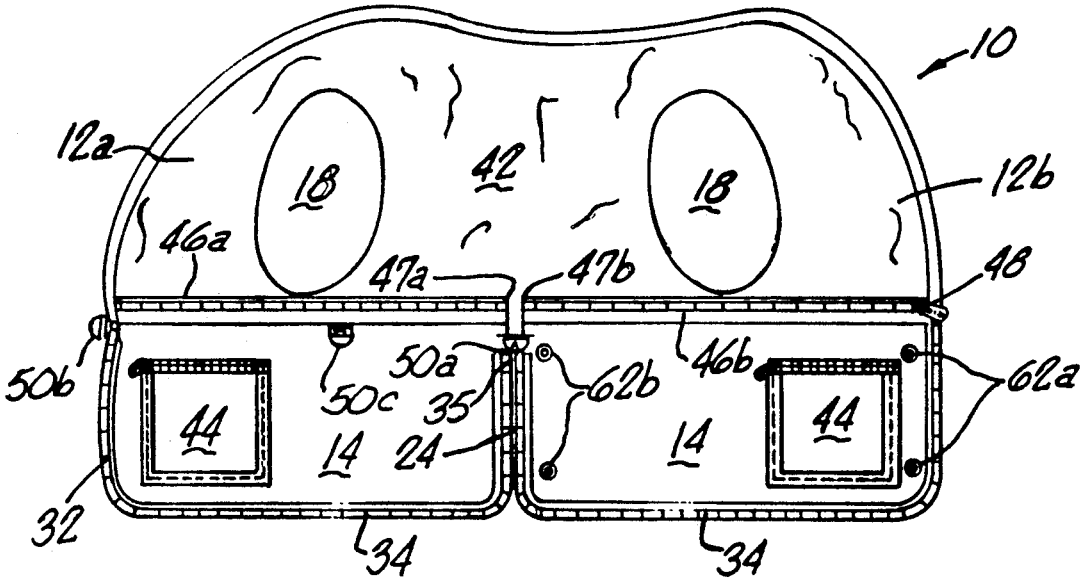
FIG. 3*b* is a view similar to that of FIG. 3A, but showing the side that forms the interior of the garment configuration and the exterior of the tote bag configuration.

The interior of the vest is shown in FIG. 3*b*. The vest is preferably made of a double layer of material, so that interior surfaces of the front panels 12*a*, 12*b* and the back portions 14, 16 define a contiguous interior surface or liner 42 that serves as both a lining for the vest, and (as will be seen) as the exterior of the tote bag into which the vest will be converted. One or more pockets 44 may be provided in the interior of the vest. These pockets 44 are located so as to form external pockets when the vest is converted into a tote bag, as will be described below.

The device is provided with bag closure means, comprising first and second horizontally-aligned rows of releasable fastening elements disposed across the interior of the vest, just below the arm holes 18. In the preferred embodiment, the bag closure means includes a second zipper, comprising first and second, horizontally-aligned, single rows of teeth 46*a*, 46*b*. The first and second rows of teeth 46*a*, 46*b* extend from points near opposite front panel edges 17*a*, 17*b*, respectively, near the front terminus 33 of the main zipper, to end points 47*a*, 47*b* proximate the middle of the back of the garment, near and slightly above the rear terminus 35 of the main zipper. The respective end points 47*a*, 47*b* of the two rows of teeth 46*a*, 46*b* are separated by a short space in the middle of the back of the garment, above the rear terminus 35 of the main zipper. A slider 48 is disposed on one of the rows of teeth.

A first "D" ring 50*a* is advantageously attached to the liner 42 in the gap between the rows of teeth 46*a*, 46*b*; a second "D" ring 50*b* is similarly attached near one outer edge of the vest; and a third "D" ring 50*c* is similarly attached approximately mid-way between the first and second "D" rings. The three "D" rings are preferably in substantial alignment, and they provide means for the removable attachment of a strap or handle for carrying the bag, as will be described below.

The manner of using the present invention is described as follows:

When worn as a vest, the device 10 has the configuration shown in FIGS. 1 and 2. The main zipper slider 36 is engaged at the front terminus 33 of the main zipper track 32, and pulled down the front panel edges 17*a*, 17*b* to close the main zipper down to approximately the bottom edge segments 34*a*, 34*b*, thereby closing the vest around the torso of the wearer (not shown).

To convert the vest into a bag, the main zipper is opened by sliding its slider 36 up to the front terminus 33 of the zipper, and disengaging the slider 36 from one of the rows of teeth constituting its track 32, allowing the wearer to remove the vest. The slider 36 of the main zipper is then re-tracked, and zipped down along the front panel edges 17*a*, 17*b*, then along the bottom edge segments 34*a*, 34*b*, and then along the bifurcation edges 24 to the rear terminus 35 of the main zipper in the lower back portion 14 of the garment. The garment is turned inside-out, forming a bag 52 with the main zipper track 32 defining a closed bottom 54 and ends 56, and with the liner 42 forming the exterior surface of the bag. The resulting intermediate configuration is shown in FIG. 4, wherein the rows of teeth 46*a*, 46*b* of the second, or bag closure zipper are brought along side each other to define a pair of opposed, substantially parallel edges of an open bag top. (In FIG. 4, only one row of teeth 46*b* is shown, the other row 46*a* being hidden behind it.) The second zipper is left open, so that the bag has an open top.

Next, as shown in FIGS. 5 and 6, the upper portion of the garment (i.e., the upper back portion 16 and the upper portions 20*a*, 20*b* of the front panels 12*a*, 12*b*) is folded down over the lower portion, thereby tucking the upper portion of the garment into the open top of the bag. (If, in the garment configuration, the device has sleeves, as for example, a jacket, the sleeves would also be tucked into the open bag top during this step.) The fold line of the upper portion of the garment is such as to expose the two rows of teeth 46*a*, 46*b* to each other along the edges of the top of the bag, thereby forming a track 58 for the second, or bag closure zipper. The slider 48 of the bag closure zipper is then used selectively to close and reopen the bag. Conversion of the bag back into a garment is accomplished by a simple reversal of the above-described steps.

FIGS. 5 and 6 also show the attachment of a removable shoulder strap 60 to the bag 52, by suitable attachment means, such as first and second snap hooks 61*a*, 61*b* that releasably attach the opposite ends of the strap 60 to the first and second "D" rings 50*a*, 50*b*, respectively. Alternatively, a shorter hand strap or handle (not shown) may be used instead of the shoulder strap 60

As configured in FIGS. 5 and 6, the bag 52 may have a tendency to sag in the middle when carried, even when only partially full. To minimize this tendency, and to make the bag more compact and convenient to carry when empty or partially full, suitable releasable fastening means may be provided to allow the bag to be folded over along a central vertical axis to fasten the bag ends 56 to each other, as shown in FIG. 7. In the preferred embodiment, the fastening means may take the form of male and female snap fasteners 62*a*, 62*b* attached to the lower interior portion of one of the side panels 12*b* (FIG. 3*b*), thereby being exposed on the exterior of one side of the bag 52 after the conversion process is completed, as seen in FIG. 6. Alternatively, hook-and-loop fasteners (not shown), of the type marketed under the trademark "VELCRO", may be used as the releasable fastening means. In this folded configuration, the snap hook 61*b* at one end of the strap 60 is attached to the third, or middle "D" ring 50*c*, as shown in FIG. 7.

From the foregoing description, it can be appreciated that the present invention is uniquely advantageous for its intended purposes. It provides a fully functional garment, in the form of a garment that is quickly and easily converted into a tote bag or the like, with little or no compromise in the utility of the device in either the garment or the bag configuration. Moreover, the aesthetic qualities of the device in both configurations can be maintained to an acceptable degree. Furthermore, the device is both simple and economical to manufacture.

While a preferred embodiment of the invention has been described above and illustrated in the drawings, it will be appreciated that a number of modifications and variations will suggest themselves to those skilled in the pertinent arts. For example, as previously mentioned, the device can be made such that in its garment configuration, it has sleeves. Also, the second, bag closure zipper can be replaced with a plurality of snap fasteners, hook-and-loop fasteners, buttons, or clasps. The shoulder strap 60 (or hand strap) can be removably attached to the bag 52 by such alternative fastening means as buttons, buckles, or the like. These and other modifications and variations that may suggest themselves should be considered within the spirit and scope of the present invention, as set forth in the claims that follow.

What is claimed is:

1. A garment that is convertible into a carrying bag, comprising:

a lower back portion having an exterior surface, an interior surface, and a central vertical bifurcation having a pair of opposed bifurcation edges and an upper end;

an upper back portion joined to the lower back portion, and having an exterior surface and an interior surface;

first and second opposed front panels joined to opposite sides of the lower back portion, the front panels each having an exterior surface and an interior surface, the panels defining a pair of opposed front edges, each extending vertically from a front terminus to a bottom edge segment, each of the bottom edge segments being contiguous with one of the bifurcation edges;

a substantially contiguous interior surface formed by the interior surfaces of the first and second front panels and of the upper and lower back portions;

a zipper having a track extending from the front terminus, then along the opposed front edges, the bottom edge segments, and the bifurcation edges, to a rear terminus at the upper end of the bifurcation;

bag closure means, comprising first and second, horizontally-aligned rows of fastening elements, the first row of fastening elements extending horizontally across the contiguous interior surface from a first point near the front edge of the first front panel to a second point near the rear terminus, the second row of fastening elements extending horizontally across the contiguous interior surface from a third point near the front edge of the second front panel to a fourth point near the rear terminus, the second and fourth points being separated by a space near the rear terminus;

whereby, when the zipper is closed along substantially the entire length of the track, and the garment is turned inside-out, a bag is formed with the zipper track defining a closed bottom and first and second opposed closed ends for the bag, and with the first and second rows of fastening elements defining a pair of opposed, substantially parallel bag top edges that define a bag opening therebetween.

2. The garment of claim 1, wherein the zipper includes a slider that is disposed on the track so as to close the zipper along the front edges when the slider is moved along the track from the front terminus toward the bottom edge segments, thereby to join the first and second front panels to each other.

3. The garment of claim 2, wherein the slider closes the zipper along the entire length of the track when the slider is moved along the track from the front terminus to the rear terminus, thereby forming the closed bottom and ends of the bag when the garment is turned inside-out.

4. The garment of claim 1, further comprising:

cover means, fixed to the exterior surface of the lower back portion, for covering the bifurcation.

5. The garment of claim 4, wherein the cover means includes a pocket.

6. The garment of claim 1, further comprising:

exterior pocket means affixed to the exterior surface of at least one of the first and second front panels.

7. The garment of claim 1, further comprising:

interior pocket means affixed to the contiguous interior surface, so as to become exposed on the exterior of the bag formed when the zipper is closed along substantially the entire length of the track, and the garment is turned inside-out.

8. The garment of claim 1, wherein each of the front panels includes an upper front portion, and wherein the upper front portions and the upper back portion are foldable into the bag opening so that the first and second rows of fastening elements are engageable with each other selectively to open and close the bag opening.

9. The garment of claim 8, wherein the zipper is a first zipper and the track is a first track, wherein the bag closure means includes a second zipper, and wherein each of the first and second rows of fastening elements comprises a row of zipper teeth, the rows of zipper teeth defining a second track for the second zipper when the upper front portions and the upper back portion are folded into the bag opening.

10. The garment of claim 1, further comprising:

means fixed to the contiguous interior surface for removably attaching a carrying strap to the bag.

11. The garment of claim 1, further comprising:

releasable fastening means, on the contiguous interior surface, for removably fastening the first end of the bag to the second end of the bag when the bag is folded along a vertical axis located between the first and second ends of the bag.

12. A garment for covering the upper torso of a human being, the garment being convertible into a carrying bag, comprising:

a lower back portion having an exterior surface, an interior surface, and a central vertical bifurcation defined between first and second bifurcation edges and having a rear terminus at the upper end of the bifurcation;

an upper back portion joined to the lower back portion and having an exterior surface and an interior surface;

first and second opposed front panels joined to opposite sides of the upper and lower back portions, each front panel having an upper portion and a substantially vertical front panel edge facing the front panel edge of the other front panel and contiguous with a bottom edge segment that is contiguous with one of the bifurcation edges;

zipper means for releasably joining (a) the front panel edge of the first front panel and the front panel edge of the second front panel to each other, (b) the first and second bottom edge segments to each other, and (c) the first and second bifurcation edges to each other, whereby, when the garment is turned inside-out, the junctures of the front panel edges of the first and second panels to each other, the first and second bottom edge segments to each other, and the first and second bifurcation edges to each other form a bag having a closed bottom, first and second opposed closed ends, and a pair of opposed top edges defining a bag top opening therebetween; and bag closure means, on the opposed top edges, for selectively opening and closing the bag top opening when the upper portions of the first and second front panels and the upper back portion are folded into the bag top opening.

13. The garment of claim 12, wherein the front panel edges define a front terminus, and wherein the zipper means includes a track extending from the front terminus, along each of the front panel edges, each of the bottom edge segments, and each of the bifurcation edges, to the rear terminus.

14. The garment of claim 13, wherein the zipper means includes a slider that joins the front panel edges together as the slider is moved along the track from the front terminus toward the bottom edge segments.

15. The garment of claim 14, wherein the slider closes the zipper means along substantially the entire length of the track when the slider is moved along the track from the front terminus to the rear terminus, thereby forming the closed bottom and ends of the bag when the garment is turned inside-out.

16. The garment of claim 13, wherein the back portion and the first and second front panels define a contiguous interior surface, and wherein the bag closure means comprises first and second horizontally-aligned rows of fastening elements, the first row of fastening elements extending horizontally across the interior surface from a first point near the front panel edge of the first front panel to a second point near the rear terminus, the second row of fastening elements extending horizontally across the interior surface from a third point near the front panel edge of the second front panel to a fourth point near the rear terminus, the second and fourth points being separated by a space near the rear terminus;

whereby, when the zipper means is closed along substantially the entire length of the track, and the garment is turned inside-out, the track defines the closed bag bottom and the first and second opposed closed ends for the bag, and the first and second rows of fastening elements define the bag top edges that define the bag opening therebetween.

17. The garment of claim 16, further comprising:
interior pocket means affixed to the contiguous interior surface, so as to become exposed on the exterior of the bag formed when the zipper means is closed along substantially the entire length of the track and the garment is turned inside-out.

18. The garment of claim 16, wherein the zipper means includes a first zipper, the track is a first track, the bag closure means includes a second zipper, and the first and second rows of fastening means respectively include first and second rows of zipper teeth.

19. The garment of claim 18, wherein the second zipper includes a slider, and wherein the upper front portions and the upper back portion are foldable into the bag opening so that the first and second rows of zipper teeth form a second track along which the slider is movable selectively to open and close the bag opening.

20. The garment of claim 16, further comprising:
means fixed to the contiguous interior surface for removably attaching a carrying strap to the bag.

21. The garment of claim 16, further comprising:
releasable fastening means, on the contiguous interior surface, for removably fastening the first side of the bag to the second side of the bag when he bag is folded along a vertical axis located between the first and second sides of the bag.

22. The garment of claim 12, further comprising:
cover means, fixed to the exterior surface of the lower back portion, for covering the bifurcation.

23. The garment of claim 22, wherein the cover means includes a pocket.

24. The garment of claim 12, wherein each of the first and second front panels has an exterior surface, the garment further comprising:
exterior pocket means affixed to the exterior surface of at least one of the first and second front panels.

25. A method of converting a garment into a bag, comprising the steps of:
(1) providing a garment comprising: (a) first and second opposed front panels, each front panel having an upper portion, the front panels defining first and second substantially vertical front panel edges that are respectively contiguous with first and second bottom edge segments; (b) a back portion joining the first and second front panels, the back portion including an upper back portion joined to a lower back portion; and (c) a central vertical bifurcation in the lower back portion, defined between first and second opposed bifurcation edges and having a rear terminus at the upper end thereof, each of the bifurcation edges being contiguous with one of the first and second bottom edge segments;
(2) joining the front panel edge of the first front panel and the front panel edge of the second front panel to each other;
(3) joining the first and second bottom edge segments to each other;
(4) joining the first and second bifurcation edges to each other;
(5) turning the garment inside-out, whereby the junctures of the front panel edges of the first and second panels to each other, the first and second bottom edge segments to each other, and the first and second bifurcation edges to each other form a bag having a closed bottom, first and second opposed closed ends, and a pair of opposed top edges defining a bag top opening therebetween; and
(6) folding the upper portions of the first and second front panels and the upper back portion into the bag top opening.

* * * * *